United States Patent [19]

Pellerin

[11] Patent Number: 4,726,125

[45] Date of Patent: Feb. 23, 1988

[54] TUMBLE DRYERS

[75] Inventor: Norvin L. Pellerin, New Orleans, La.

[73] Assignee: Pellerin Milnor Corporation, Kenner, La.

[21] Appl. No.: 908,342

[22] Filed: Sep. 17, 1986

[51] Int. Cl.[4] ..... F26B 11/04

[52] U.S. Cl. ..... 34/82; 34/191; 34/133

[58] Field of Search ..... 34/82, 191, 133; 55/293, 470, 471

[56] References Cited

U.S. PATENT DOCUMENTS 1,427,580 8/1922 Collins .

2,422,825 6/1947 Davis, Jr. ..... 34/82

4,268,247 5/1981 Freze ..... 432/21

4,538,361 9/1985 Gresens ..... 34/82

*Primary Examiner*—Larry I. Schwartz

*Attorney, Agent, or Firm*—Vaden, Eickenroht, Thompson & Boulware

[57] ABSTRACT

There is disclosed a tumble dryer for cloth goods having a filter for collecting lint carried by heated air circulated through cloth goods contained within a rotatable drum, and a system for removing lint collected on the filter by causing air to be drawn through it in a direction opposite to that in which it passes during a drying cycle as well as to be swept across the upstream side of the filter and then out of the dryer for disposal.

7 Claims, 6 Drawing Figures

29
20
54
26
14
11
25
24
55

2
3
35
31
22
23
21
16
13
41
40
11
42
24
37
15
12
10
27

TUMBLE DRYERS

This invention relates to tumble dryers for cloth goods, and, more particularly, to a dryer of this type having an improved system for collecting and removing lint from the heated air as it circulates through the dryer.

As well known in the art, in conventional dryers of this type, the drum includes a perforated cylindrical wall rotatable within a housing as heated air is caused to circulate into and out of the housing and through the drum in order to dry the goods therein. Thus, the housing includes a first space connecting an air inlet with a first perforated portion of the drum wall and a second space connecting a second perforated portion of the drum wall with the air outlet. A blower is connected to the air outlet for causing the air to be drawn from the inlet and into the drum through the first perforated portion and out of the drum through the second perforated portion so that it must pass through the goods themselves. A means is also often provided for recirculating at least a portion of the heated air to which additional ambient air has been added during the drying cycle.

In an improved tumble dryer of this type, which is shown and described in a co-pending application, Ser. No. 656,767, filed Oct. 1, 1984, Now U.S. Pat. No. 4,640,024 and entitled "Apparatus For Treating Cloth Goods", and assigned to the assignee of the present application, heated air is caused to circulate from the inlet radially into the drum, axially of the drum, and then radially out of the drum and into the air outlet. For this purpose, and as shown in such application, the spaces are formed on opposite sides of a dividing wall having a ring which closely surrounds the perforated wall portion intermediate its ends to confine substantially all of the air flow in the manner described.

It has been proposed to provide dryers of this general type with systems for periodically collecting and removing lint from the air. For example, suction devices have been provided for sweeping across the upstream side of a filter mounted across the second space intermediate the second portion of the drum and the dryer outlet. However, such systems are not only quite complicated and expensive, but also require considerable "down time" —i.e., stoppage of the drying cycle.

U.S. Pat. Nos. 2,422,825 and 4,268,267 show systems which are less complex and require less down time in that they include walls or louvers which may be moved between positions establishing alternate air circulation paths during drying and delinting cycles. Thus, in one position, and during a drying cycle, the louvers cause air to circulate through and thus collect on the upstream side of the filter, and, in the other position, and following stoppage of the drying cycle and during a delinting cycle, the louvers cause the air to either circulate in a reverse direction through the filter or to sweep across the upstream side of the filter. Dampers in the inlet and outlet, which are normally closed or at least partially closed, during recirculation of heated air during the drying cycle, are opened during the delinting cycle to permit ambient air to be drawn from the inlet into and through outlet into a conduit connecting with the dryer housing and having suitable means for collecting and removing the lint from the dryer. In some cases, the filter is moved along with the louvers to dispose it in the desired position relative to air circulation during the delinting cycle. Obviously, the louvers, and in some cases the filters, may be automatically moved between their alternate positions on a predetermined time basis.

The primary object of this invention is to provide a tumble dryer having a system for removing and collecting lint in which air can be circulated both through and across the upstream side of the filter in order to more effectively remove lint therefrom.

Another object is to provide such a system which is especially well suited for use in a tumble dryer of the type shown and described in the aforementioned application.

These and other objects are accomplished, in accordance with the illustrated embodiment of this invention, by a dryer having a filter which is mounted across the second or outlet space in the housing for collecting lint from the air as it passes from the drum to the outlet, a normally closed conduit which connects with the second space near the upstream side of the filter, and a secondary blower which, upon opening of the conduit, is adapted to draw air from the second space into and through the conduit. More particularly, a porous lint container is disposed in the conduit upstream of the secondary blower, and a means is provided upon opening of the conduit, is adapted to draw air from the second space into and through the conduit. More particularly, a porous lint container is disposed in the conduit upstream of the secondary blower, and a means is provided for opening the conduit and so confining air circulating within the second space that, upon stoppage of the main blower and operation of the second blower, air will be drawn from the inlet and across the upstream side of the filter as well as from the outlet and through the filter in a direction opposite that in which the air circulates during a drying cycle. In this manner, lint is removed and carried it into the container for collection and removed from the dryer with greater efficiency than would be possible with prior systems of the type above described. In the preferred and illustrated embodiment, dampers in the outlet may be operated for increasing or decreasing the flow area therein and thus creating periodic pulses in the air drawn through the outlet and the filter during the delinting cycle in order to further enhance removal of the lint.

As illustrated, the dryer is of the type shown and described in the aforementioned co-pending application wherein the spaces are formed on opposite sides of a dividing wall having a ring which closely surrounds the perforated drum wall intermediate its ends. As previously described, air is thus caused to be circulated radially into the drum through the first perforated wall portion, axially of the drum, and then radially out of the drum through the second perforated wall portion. In this preferred and illustrated embodiment of the invention, the conduit connects with the second space adjacent one side of the housing opposite one side of the drum wall, and the housing has walls which, when the conduit is closed, occupy first positions permitting the air to pass directly into the outlet, but, upon opening of the conduit, occupy second positions forming a duct having an inlet opening near the opposite side of the housing, and thus on the other side of the drum, and an outlet opening at its opposite end near the connection of the conduit to the second space, thereby confining air to flow across the upstream side of the filter.

In the drawings, wherein like reference characters are used throughout to designate like parts:

Figure 1:
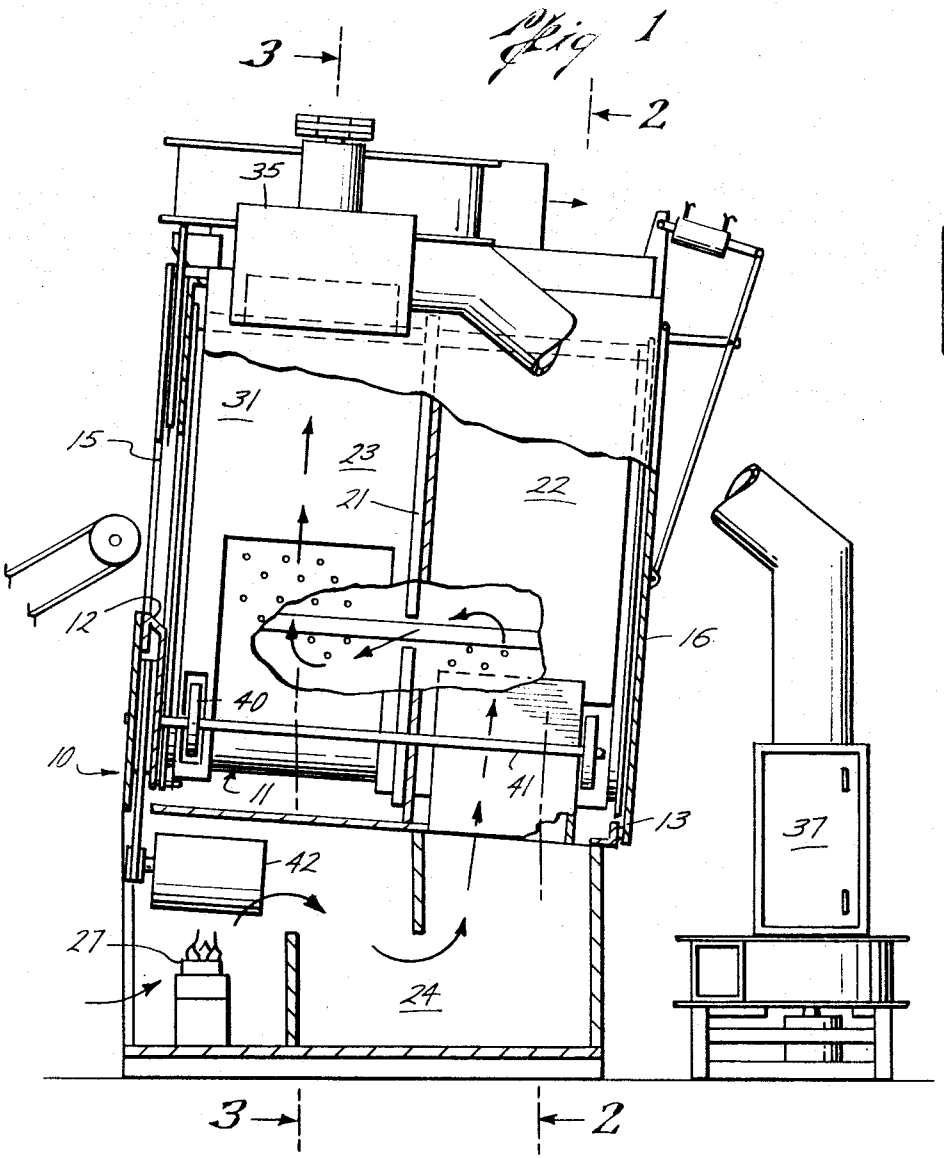
FIG. 1 is a view of one side of a dryer constructed in accordance with this invention, partly in elevation and partly in section, broken away to illustrate with arrows the circulation of heated air therethrough during a drying cycle, and showing the conduit to which the secondary blower is connected to drawing air from the housing through a lint container in the conduit during a delinting cycle.
Figure 3:
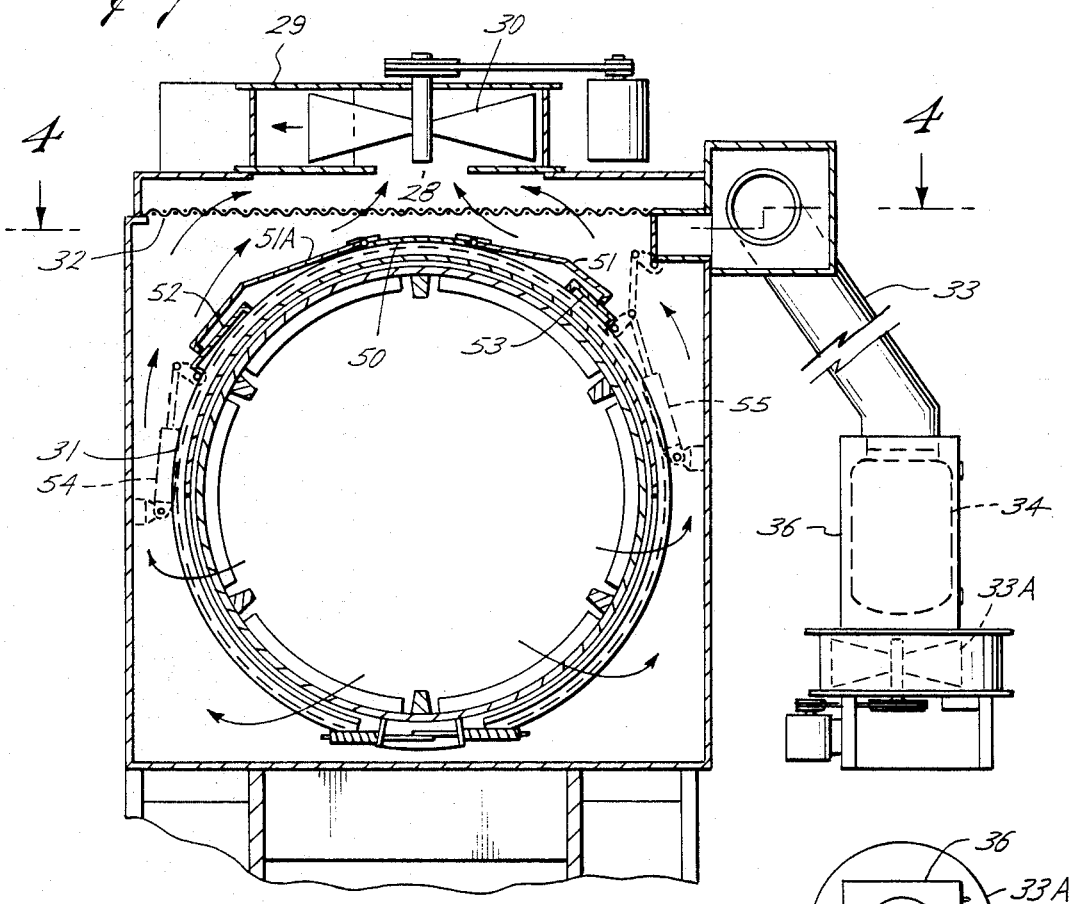
Figure 4:
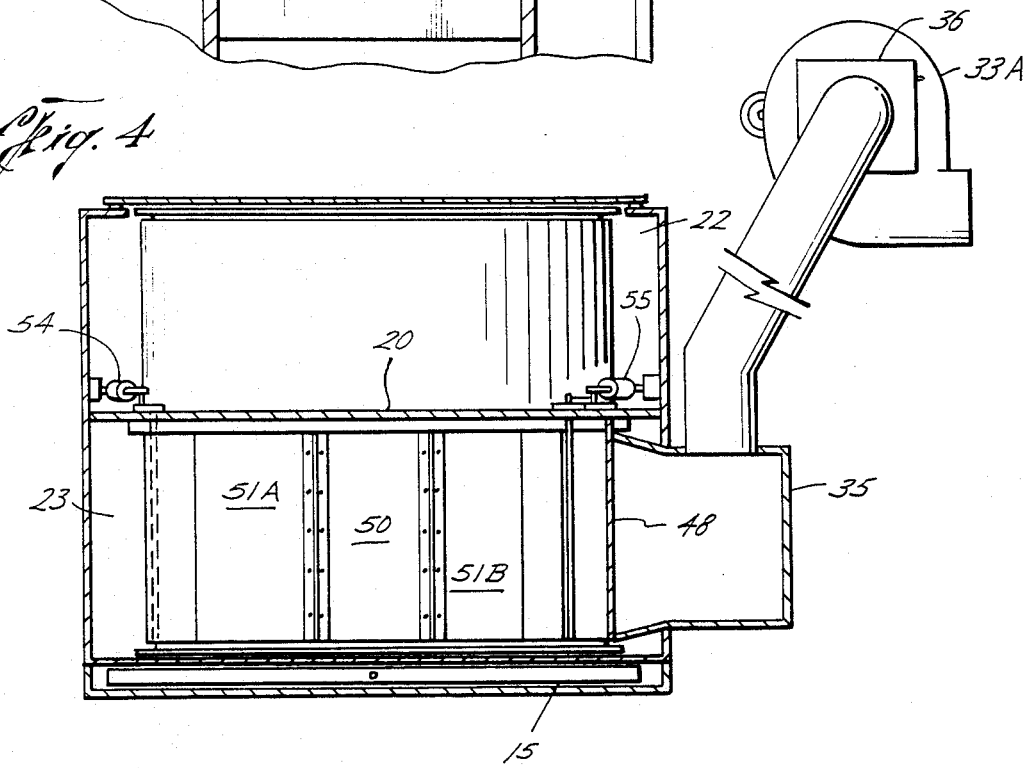
Figure 5:
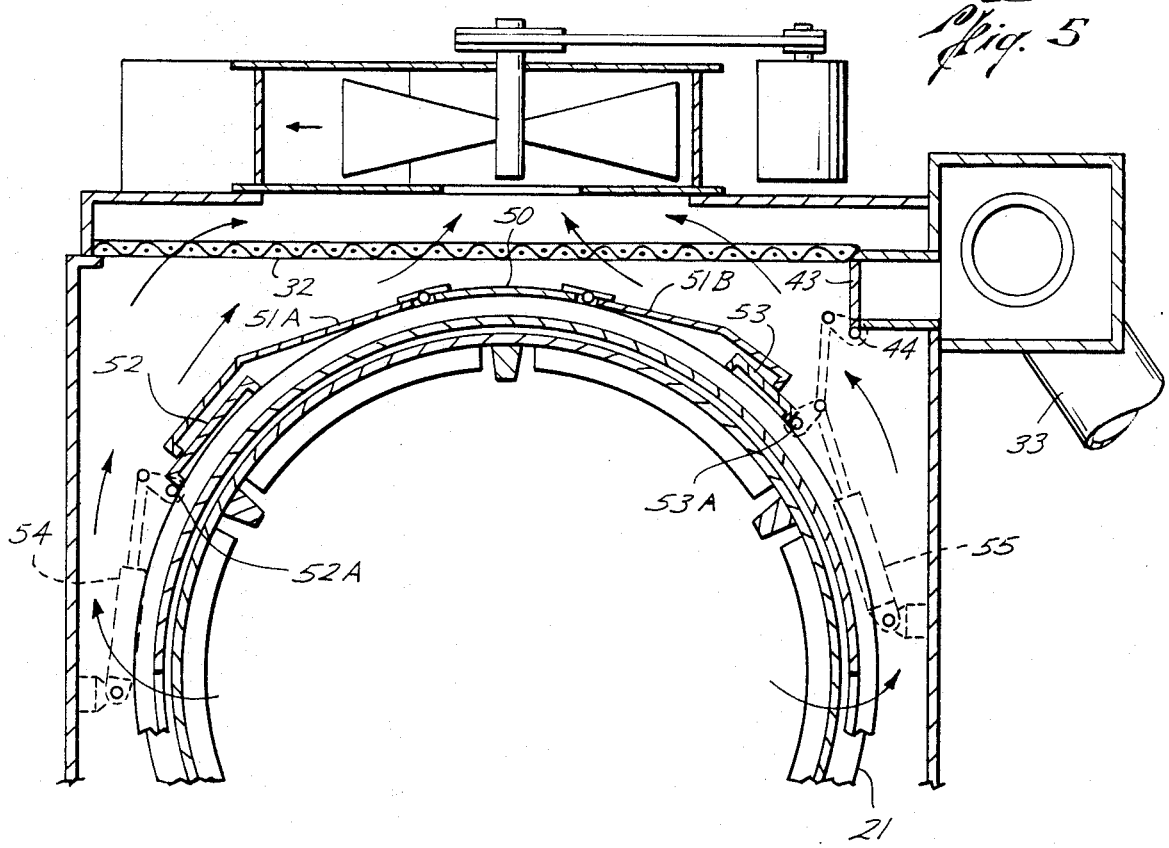
Figure 6:
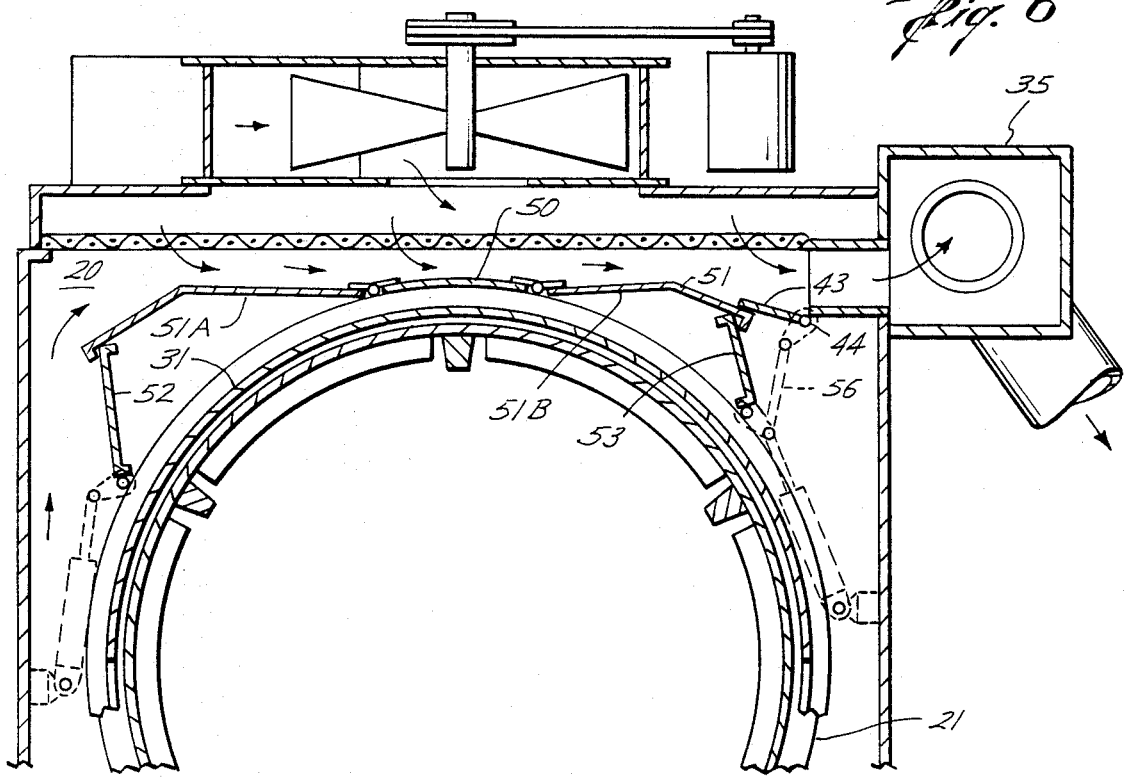

FIG. 3 is a vertical sectional view of the dryer of FIG. 1, as seen along broken lines 3—3 thereof, illustrating with arrows the circulation of air out of the drum through the second perforated wall portion into the second space and into the outlet in which the main blower is mounted, and further showing the duct forming walls in the position they occupy during the drying cycle, and, in broken lines, the lint container in the conduit and secondary blower connected thereto;

FIG. 4 is a horizontal sectional view of the dryer, as seen along broken lines 4—4 of FIG. 3;

FIG. 5 is an enlarged vertical sectional view of the upper portion of the dryer of FIG. 3, including the duct forming walls extending across the upper portion of the drum, as shown in FIG. 3, to permit the free circulation of air along both sides of the drum and over the top of the drum and into the outlet during a drying cycle, as illustrated arrows; and FIG. 6 is a view similar to FIG. 5, but upon opening of the conduit and movement of the walls to positions over the top of the drum in which they form a duct so that upon stoppage of the main blower and start up of the secondary blower, the flow of air from the drum is confined to pass across the upstream side of the filter during a delinting cycle, this flow of air as well as the flow of air is a reverse direction through the outlet and filter being illustrated by arrows.

The dryer is shown in the above described drawings to include a housing 10 adapted to be mounted on a the floor of a laundry or other horizontal support surface, and a drum 11 mounted for rotation within the housing with its longitudinal axis disposed at a relatively small angle with respect to the horizontal. The housing has an opening 12 in one end and an opening 13 in its opposite end, and the drum includes a cylindrical wall 14 which is perforated throughout its length and is open at both ends opposite the housing openings so that cloth goods may be deposited in the drum through the left hand opening 12 and removed therefrom following drying through the right-hand opening 13. The drum is stationary during loading and unloading, and the openings 12 and 13 housing as well as open ends of the drum are adapted to be closed, as the drum rotates during a drying cycle, by means of a vertically reciprocable door 15 and a pivotally swingable cover 16. As fully described in the aforementioned co-pending application, the door and cover are selectively opened to permit loading and unloading of the goods.

As also fully described in detail in the aforementioned co-pending application, a wall 20 is disposed across the housing intermediate its ends and has an annular recess therein to receive a ring 21 which closely surrounds the perforated wall of the drum intermediate its ends. This then divides the area between the housing and the perforated wall of the drum into first and second spaces 22 and 23, the first space being disposed on the lower right-hand end of the housing, and the second space 23 surrounding the upper inclined end of the drum.

Figure 2:
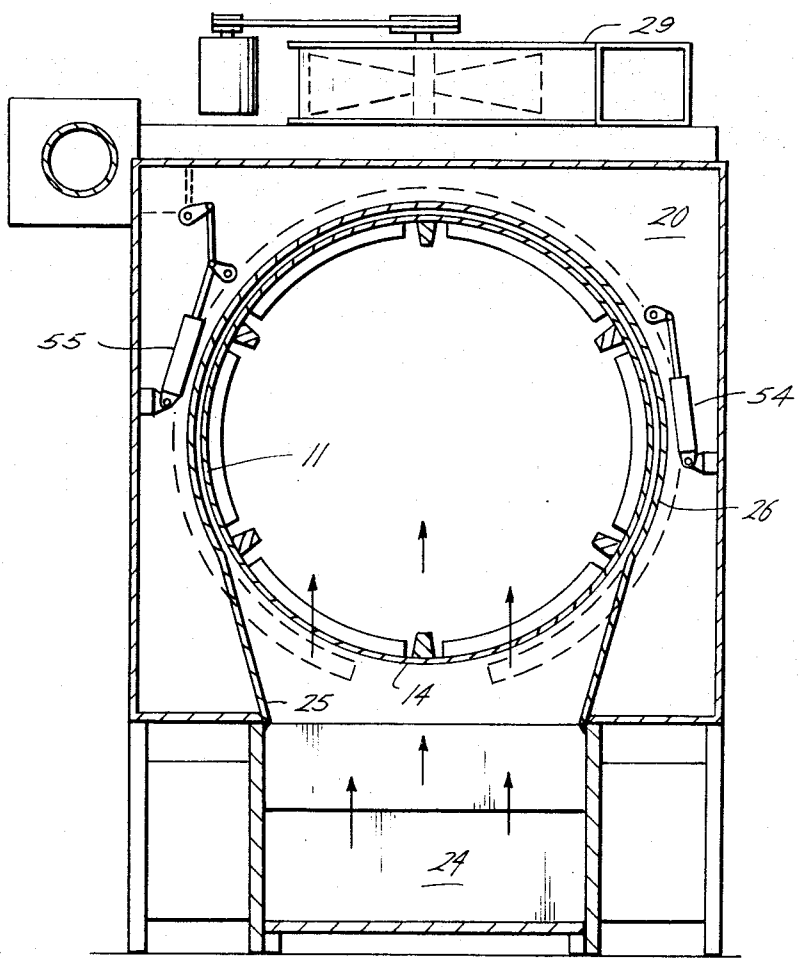
FIG. 2 is a cross vertical sectional view of the dryer of FIG. 1, as seen along broken lines 2—2 thereof, and further illustrating with arrows the circulation of heated air from the inlet into the first space and into the drum through the first perforated wall portion of the drum.

An inlet to the lower space 22 includes a lower compartment 24 beneath an upper compartment in which the drum is rotatably mounted, and a duct 25 which extends from the lower compartment into space 22 in the upper compartment to connect with an inner housing wall 26 closely surrounding the upper portion of the drum, as shown in FIG. 2. As shown in FIG. 1, the left end of the lower compartment is open to permit air to be drawn over a gas burner 27 therein and thus heated as it enters the housing and flows upwardly into the first space. An outlet from the upper space 23 of the housing includes an opening 28 in the top wall of the upper compartment of the housing leading to a sub housing 29 in which a main blower 30 is mounted for drawing air upwardly from the second space into and out of the dryer housing.

As best shown in FIG. 3, the housing also includes an inner wall 31 in the second space which closely surrounds the upper portion of the perforated wall of the drum. As will be understood from the drawings, especially in view of the arrows of FIGS. 1 to 3, the main blower thus draws air upwardly through the inlet and into the drum through the first perforated wall portion in the first space, then axially of the drum, and out of the drum through the perforated wall portion of the drum into the second space. More particularly, the inner wall in the second space causes air leaving the drum through the upper perforations therein to move downwardly before passing upwardly over the inner wall and into the outlet.

The drum 23 is supported within and rotated with respect to the housing by means of rollers 40 (see FIG. 1) near each end and on opposite sides of the lower half of the drum. These rollers are mounted on shafts 41 which extend lengthwise of the drum and have their opposite ends journaled in the front and rear walls of the housing and which are rotated by means of a belt driven by a motor 42, all as described in detail in the aforementioned pending patent application.

As shown in the drawings, a filter 32 is mounted across the upper portion of the second space of the housing intermediate the drum and the outlet from the housing. As also previously described, a conduit 33 connects at one end with one side wall of the second space adjacent the upstream side of the filter, and a secondary blower 33A is connected to the outer end of the outlet so that air is drawn from within the dryer and into and through the outlet when the conduit is open during a delinting cycle. As also previously described, a porous bag 34 is disposed within the outlet so as to collect lint which is drawn from the housing by means of the secondary blower to permit its removal from the housing.

As shown, the conduit includes a subhousing 35 mounted on and having an upper end extending into the dryer housing adjacent its upper end and a tube connect with a side of the subhousing and having a lower end connecting with a sub housing 36 for the lint container mounted on a housing for the secondary blower 33A. A door 37 in the side of the housing 36 permits removal of a bag which is full of lint and replacement with an empty bag.

The inner end of the sub housing 35, which opens to the second space adjacent the one side edge of the filter, is adapted to be opened and closed by means of a door 43 pivotally mounted on the subhousing for swinging about a horizontal axis. The door 43 is adapted to be closed during a drying cycle so that heated air is confined for flow upwardly along opposite sides and over the top of the drum and through the filter into the outlet, as shown by the arrows in FIG. 3. On the other hand, as will be described in detail to follow, upon initiation of a delinting cycle, and stoppage of the main blower 30, the door is adapted to be moved into the open position of FIG. 6, and the secondary blower 33A is started so that lint carried by the air within the housing is drawn through the conduit 33 and thus into the lint bag. More particularly, in a manner to be described to follow, this air includes heated air which has been drawn across the upstream side of the filter as well as ambient air which has been drawn through the outlet and filter in a direction opposite to that in which it is drawn during a drying cycle, and thus from the downstream to the upstream side of the filter.

Heated air leaving the drum within the second space is confined for flow past the upstream side of the filter by walls which extend between the inlet end wall and dividing wall 20 of the housing. The wall are adapted to be moved from the positions shown in FIGS. 3, 4 and 5, during a drying cycle to permit heated air to flow unrestrictedly through the filter and into the outlet, into the positions shown in FIG. 6 wherein they form with the walls of the housing a duct connecting the upper end of the second space on the left hand side drum with the left hand open end of the conduit. More particularly, the walls forming the duct are adapted to be so moved, as the door 43 is moved to open the conduit, by means of fluid actuators mounted in the first space portion 22 and connected to rods extending through dividing wall 20 for connection to the door and duct forming walls.

As shown in the drawings, the duct forming walls include a central stationary wall 50 which is supported on the top of the "U" shaped member of the dividing wall 20 which receives the ring 21 surrounding the perforated wall of the drum, and left and right hand walls 51A and 51B (as seen in FIGS. 5 and 6) which are pivotally connected to opposite side edges of the central wall for swinging between lower positions which they occupy during the drying cycle, as shown in FIG. 5, and raised positions which they occupy in order to form the duct during the delinting cycle, as shown in FIG. 6. These swingable side walls are moved between their alternate positions by means of arms 52 and 53 mounted on pins 52A and 53A, respectively, extending laterally of and supported by the housing adjacent opposite sides of the upper portion of drum. Thus, the pins are adapted to be rotated by the actuators 54 and 55 to cause the upper ends of the arms to slide along the bottom of the side walls 51A and 51B so as to permit them to swing downwardly to the positions of FIG. 5, when the arms are swung inwardly toward the drum, and to be lifted into their duct forming positions, as the arms are swung away from the drum, as shown in FIG. 6.

As also shown in FIGS. 5 to 6, the door 43 for opening and closing the end of the conduit 33 connecting with the second space of the dryer is adapted to be supported in its open position on the upper edge of the right hand wall 51 so as to form a continuation of the right end of the duct. On the other hand, when arm 52 is swung away from the drum to lift left hand wall 51A to duct forming position, it forms an upward continuation of the lower end portion of the inner wall 31 of the housing disposed over the upper portion of the drum in the second space, and thus connects the area between wall 31 and the adjacent side wall of the housing with the left hand open end of the duct.

As shown, the operators 54 and 55 in the first space of the dryer housing are so connected to the arms 52 and 53 and door 43 as to move the door from closed to open position as the duct forming walls are moved to duct forming position, and to move the door to closed position as the duct forming walls are moved to their lowered positions in which they permit the free flow of heated air upwardly along both sides of the drum during a drying cycle, as indicated in by the arrows in FIG. 5. For this latter purpose, and as shown in broken lines in FIGS. 5 and 6, the cylinder ends of the actuators are pivotally connected to the dividing wall 20 and the rod ends thereof are pivotally connected to crank arms which are in turn is connected to the pivotally mounted rods 52A and 53A on the lower ends of the arms 52 and 53, respectively. Thus, retraction of the actuators to the position of FIG. 6 will raise the side walls into duct forming position as arm 52 is moved into its position forming a continuation of the flow passage on the left side of the drum leading to the duct. The rod of the right hand actuator 55 is also pivotally connected by a link 56 to a crank arm on the pivotal rod 44 of the door 43 so as to swing the door downwardly to open position as the right hand actuator is retracted, and to swing the door upwardly to closed position as the right hand actuator is extended.

As previously mentioned, a damper (not shown) in the outlet, which is at least partially open during the delinting cycle so as to permit air to be drawn inwardly thus through the outlet and through the filter into the conduit 33, may be periodically moved between positions increasing or decreasing the flow passage through the blower housing in order to create pulses in the air flow which passes through the filter, thereby enhancing the delinting of the filter.

As will be understood, the dryer may be programmed to cause the duct forming walls and door of the conduit to be opened or closed at desired intervals.

From the foregoing it will be seen that this invention is one well adapted to attain all of the end and objects hereinabove set forth, together with other advantages which are obvious and which are inherent to the method and apparatus.

It will be understood that certain features and subcombinations are of utility and may be employed without reference to other features and subcombination. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

I claim:

1. A tumble dryer, comprising a housing having an air inlet and an air outlet, a drum in the housing including a perforated cylindrical wall for containing cloth goods to be dried, means for rotating the wall, means forming a first space in the housing connecting the inlet and a first perforated portion of the drum wall and a second space in the housing connecting a second perforated portion of the drum wall and the outlet, a main blower connecting with the outlet for causing air to be drawn into the inlet, throughthe perforated protion of the drum wall, and thus the cloth goods in the drum, and out the outlet, means for heating the air as it circulates through the dryer, a filter mounted across the second space for collecting lint from the air as it passes from the drum to the outlet, a conduit connecting the second space near the upstream side of the filter with the exterior of the housing, a secondary blower for drawing air from the housing near the upstream side of the filter into and through the conduit when the conduit is open, a porous container in the conduit, and means for selectively closing the conduit, during a drying cycle, and opening the conduit and so confining air circulating within the second space that, upon stoppage of the main blower and operation of the secondary blower, air will be drawn from the outlet and through the filter and from the inlet and across the upstream side of the filter in order to remove lint therefrom and carry it into said container for collection and removal from the dryer.

2. A dryer as in claim 1, including means for periodically increasing and decreasing the flow area through the outlet, during stoppage of the main blower and operation of the secondary blower, so as to create pulses in the flow of air from the outlet and through the filter into the conduit which enhance removal of lint from the filter.

3. A dryer as in claims 1 or 2, wherein the space forming means includes a wall having a ring closely surrounding the cylindrical wall intermediate its ends to form the first space on one side thereof and the second space on the opposite side thereof, whereby heated air is caused to circulate radially into the drum through the first perforated wall portion, axially within the drum, and then radially out of the drum through the second perforated wall portion.

4. A dryer as in claim 3, wherein the outlet connects with the second space adjacent one side of the housing opposite one side of the drum wall, the housing has walls which are moveable between first positions which, when the conduit is closed, permit air to flow directly from the drum into the outlet, and second positions which, upon opening of the conduit, form a duct opposite the upstream side of the filter having an inlet at one end opening near the opposite side of the housing and an outlet at its oppoiste end opening to the connection of the open conduit to the second space, and means are provided for moving the duct forming walls between their first and second positions.

5. A dryer as in claim 4, wherein the outlet is in the upper end of the housing, the housing includes a deflecting wall over the upper portion of the second perforated portion of the drum so that air must pass along opposite sides thereof in order to enter the outlet, and the duct forming walls are over and conform closely to the deflecting wall in their first positions to permit air to flow freely past both sides of the drum.

6. A dryer as in claim 5, including a door movable between positions opening and closing the conduit adjacent its connection to the second space and forming in its open position a continuation of the duct forming walls at the opening in the opposite end thereof when said walls are in their second positions.

7. A dryer as in claim 6, wherein the moving means includes means for moving the door to its closed position as the duct forming walls are moved to their first positions and moving the door to its open position as the duct forming walls are moved to their second positions.

* * * * *